United States Patent [19]

Simo

[11] Patent Number: 4,809,670

[45] Date of Patent: Mar. 7, 1989

[54] LATERALLY ADJUSTABLE ARROW REST FOR AN ARCHERY BOW

[76] Inventor: Miroslav A. Simo, 370 N. Delaplaine, Riverside, Ill. 60546

[21] Appl. No.: 57,383

[22] Filed: Jun. 2, 1987

Related U.S. Application Data

[63] Continuation-in-part of Ser. No. 788,486, Oct. 17, 1985, Pat. No. 4,732,135, which is a continuation-in-part of Ser. No. 482,186, Apr. 5, 1983, Pat. No. 4,548,188.

[51] Int. Cl.[4] ..... F41D 10/00

[52] U.S. Cl. ..... 124/41 A; 124/24 R

[58] Field of Search ..... 124/24 R, 41 A

[56] References Cited

U.S. PATENT DOCUMENTS

| | | | |
|---|---|---|---|
| 3,769,956 | 11/1973 | Simo | 124/24 R |
| 3,828,757 | 8/1974 | Finlay | 124/24 R |
| 4,054,119 | 10/1977 | Hansen et al. | 124/24 R |
| 4,119,078 | 10/1978 | Wilson et al. | 124/41 A |
| 4,170,980 | 10/1979 | Killian | 124/41 A |
| 4,686,956 | 8/1987 | Troncoso | 124/41 A |

*Primary Examiner*—Richard C. Pinkham
*Assistant Examiner*—Benjamin Layno
*Attorney, Agent, or Firm*—Thomas W. Speckman; Ann W. Speckman

[57] ABSTRACT

An arrow rest for an archery bow which is forwardly rotatale against an adjustable spring bias upon movement of an arrow shaft and fletching across an arrow support and automatically returns to an initial predetermined position after discharge. The arrow rest mounts in a hole through the handle portion of the bow, and may provide easy lateral adjustment or complete replacement of the rest in the field.

17 Claims, 2 Drawing Sheets

FIG. 2
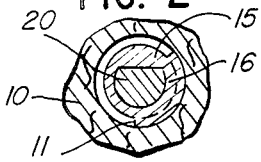
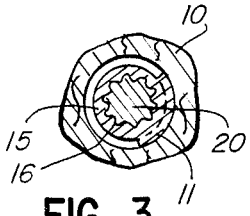
FIG. 3
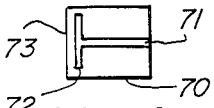
FIG. 4
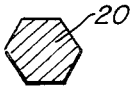
FIG. 7a
FIG. 1
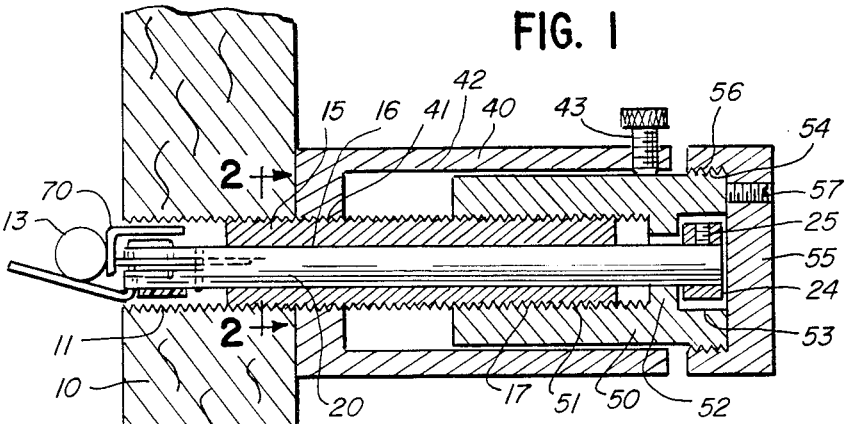
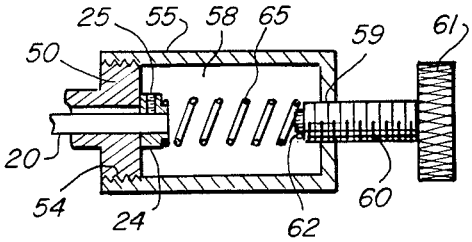
FIG. 5
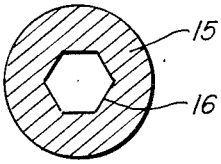
FIG. 7b
FIG. 7
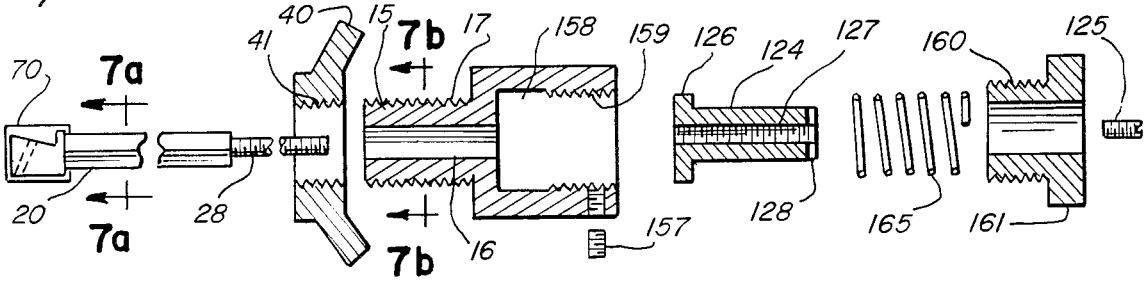
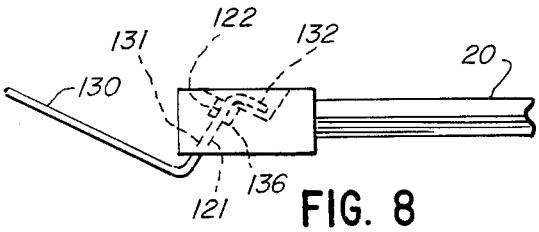
FIG. 8
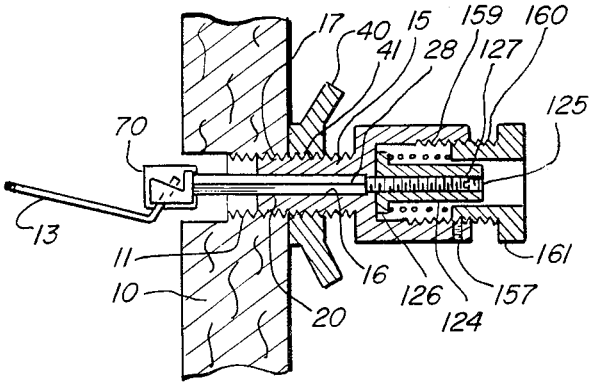
FIG. 6
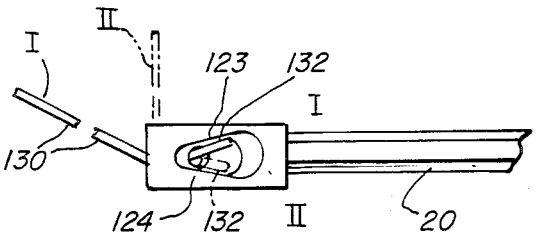
FIG. 9

LATERALLY ADJUSTABLE ARROW REST FOR AN ARCHERY BOW

CROSS REFERENCE TO RELATED APPLICATIONS

This application is a continuation-in-part of my earlier application, Ser. No. 788,486, filed Oct. 17, 1985 now U.S. Pat. No. 4,732,135 which is a continuation-in-part of my earlier application, Ser. No. 482,186, filed Apr. 5, 1983, now U.S. Pat. No. 4,548,188.

BACKGROUND OF THE INVENTION

1. Field of the Invention

This invention relates to an arrow rest for an archery bow, and more particularly to a laterally adjustable arrow rest. The lateral adjustment of the arrow rest may be readily achieved in the field and without the use of tools due to the nature of the mounting of the arrow rest through the handle area of the bow. The arrow rest may be provided with adjustable spring biased plunger and return action along its lateral axis providing horizontal cushion to the arrow upon release. The arrow rest may be provided with adjustable spring biased rotation and return action about its lateral axis providing downward cushion to an arrow support portion of the rest by such rotation. The entire arrow rest of the present invention may be replaced in the field with assurance of correct positioning and alignment.

2. Description of the Prior Art

An arrow rest is generally secured to the handle area of an archery bow, and often includes a rigid notch or ledge which supports and guides an arrow as it is discharged from the bow. However, rigid arrow rests may introduce an undesirable vertical and horizontal force component to the arrow when the shaft and fletching passes over the arrow rest, causing an unwanted deflection of the arrow and damage to the fletching.

Flexible arrow rests which deflect both vertically and horizontally by spring action when the arrow passes over the arrow rest decrease this undesired deflection, as described in U.S. Pat. Nos. 4,074,674, 3,871,352, and 3,935,854. Spring biased arrow rests deflecting in a generally horizontal plane are described in U.S. Pat. Nos. 3,769,956 and 3,828,757. Also, arrow rests may be mechanically deflected away from the arrow when the arrow is shot, as described in U.S. Pat. No. 3,504,659.

An arrow may travel laterally with respect to the bow if the arrow rest is not properly aligned on the handle. Prior arrow rests which may be laterally adjusted require the use of tools or are rigid rests, as described in U.S. Pat. Nos. 3,285,237, 3,871,352, 3,232,286 and 3,757,764. A spring-biased plunger for lateral placement of an arrow on a fixed rest is described in U.S. Pat. No. 3,482,563.

Prior arrow rests have been secured to the bow handle area with adhesive, screws, or the like, and when replacement of the arrow rest is necessary due to breakage or wear, there is no assurance that the new arrow rest, even if of the same style as the old arrow rest, will be properly positioned for shooting without essentially complete realignment. The prior art known to the applicant does not suggest an arrow rest which may be easily laterally adjusted in the field with respect to its lateral position, with respect to spring bias of its lateral plunger action, and with respect to spring bias of its rotation about its lateral axis.

SUMMARY OF THE INVENTION

It is an object of one embodiment of this invention to provide an arrow rest which may be adjusted laterally with respect to a bow upon which it is mounted without the use of tools.

Another object of this invention is to provide an arrow rest which may be mounted and remounted in the same position with respect to the bow.

Still another object of this invention is to provide a laterally adjustable arrow rest wherein complete lateral adjustment can be achieved, that is, all the way to the bow handle without the thickness of a back plate or return mechanism.

Yet another object is to provide an arrow rest having an adjustable spring biased lateral plunger depression and return action to an arrow support portion of the arrow rest.

Still another object is to provide an arrow rest having an adjustable spring biased rotation and return action about its lateral axis providing downward cushion to an arrow support portion of the arrow rest by such rotation.

The above objects are achieved in the present invention by an arrow rest having a receiving sleeve which has a first portion fixedly attachable within a transverse hole in the bow handle and an outer second portion sized to extend outwardly from the bow handle on the side away from the arrow rest when fixedly attached within the hole, the sleeve having a through opening. An elongated mounting means is adapted to fit freely longitudinally movable within the sleeve through opening. The elongated mounting means has a first end adaptable to receive an arrow support means and an opposite second end extending from the receiving sleeve second portion through opening. An arrow support means is attached to the mounting means first end. A lateral adjustment means engages the second end of the mounting means and the second portion of the receiving sleeve extending outwardly from the bow handle whereby movement of the adjustment means causes longitudinal movement of the mounting means within the receiving sleeve. The arrow support means may be a one-piece biased wire mounted in the end of the mounting means or a flat plate having a arrow support arm mounted on one side and the plate being removably attachable to a mating mounting attached-to the end of the mounting means. This invention provides an arrow rest with full lateral adjustment, prior rests requiring thickness for spring mechanisms and mounting body preventing lateral adjustment to the bow surface.

In one embodiment, pressure on the end of the arrow support mounting means by an arrow urges the mounting means inwardly. The mounting means is returned by spring action. The force opposing urging the mounting means in such depression and providing return action is adjustable.

The above features have been more fully disclosed in my issued U.S. Pat. No. 4,548,188 and in my copending application Ser. No. 788,486, filed Oct. 17, 1985, both fully incorporated herein by reference.

The present invention is directed to rotation of an elongated mounting means about its lateral axis against an adjustable spring bias and return of the elongated mounting means to an original predetermined position with respect to a receiving sleeve. Rotation of the elongated mounting means may be in combination with a laterally adjustable arrow rest as described above. The downward force imparted to an arrow support means by a released arrow causes rotation of the mounting means to an extent controlled by the adjustable spring bias which also returns the mounting means to a preset position. Such rotation caused by downward movement of the arrow support means will be termed "forward rotation" of the mounting means throughout this disclosure and claims. Forward rotational action of the mounting means aids in avoidance of porpoising of the arrow in flight and adjustability of its resistance to forward rotation allows loosening or tightening of arrow grouping on a target.

BRIEF DESCRIPTION OF THE DRAWINGS

The above mentioned and other features of this invention and the manner of obtaining them will become more apparent, and the invention itself will be best understood by reference to the following description of specific embodiments of the invention taken in conjunction with the accompanying drawings, in which:

FIG. 1 is a cross-sectional view through a bow handle from the side of the archer showing one embodiment of an arrow rest;

FIG. 2 is a cross-sectional view along line 2—2 in FIG. 1 showing one embodiment of a mounting means and receiving sleeve;

FIG. 3 is a cross-sectional view of another embodiment of a mounting means and receiving sleeve;

FIG. 4 is a bottom view of a mounting means cap;

FIG. 5 is a side sectional view of an embodiment of the adjustment screw cap portion of an arrow rest providing longitudinal biased movement of the mounting means;

FIG. 6 is a side sectional view of another embodiment of an arrow rest providing adjustable lateral plunger depression and return action;

FIG. 7 is an exploded side sectional view of the arrow rest shown in FIG. 6;

Figure 10:
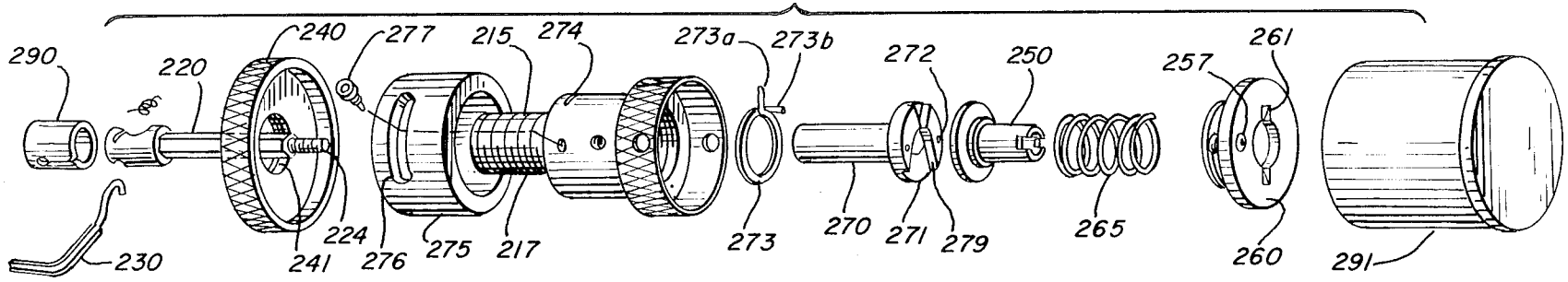
Figure 12:
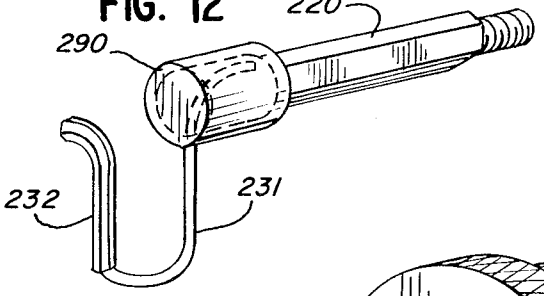
Figure 11:
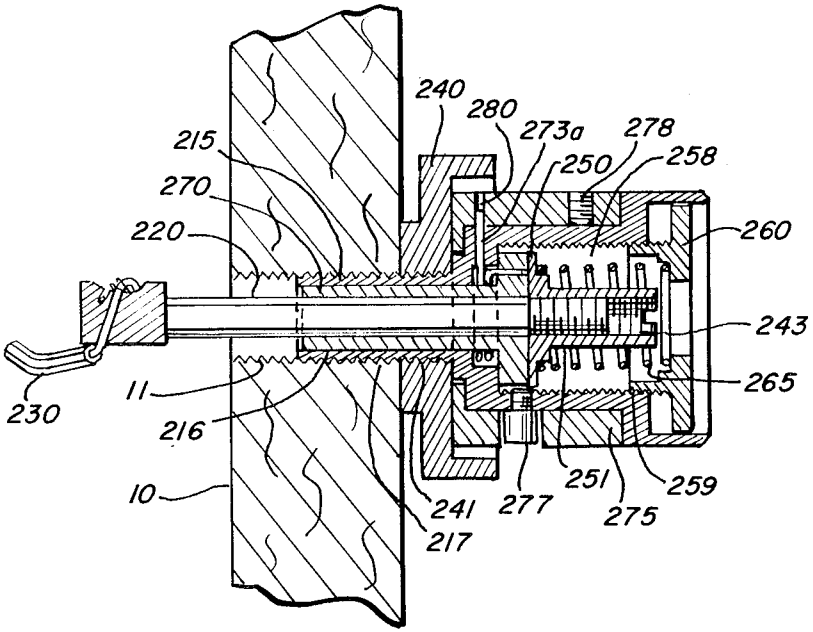

FIGS. *7a* and *7b* are sectional views as indicated in FIG. 7;

FIG. 8 is a side view of another embodiment of a mounting means showing a different mounting of an arrow support wire;

FIG. 9 is a top view of the embodiment shown in FIG. 8;

FIG. 10 is an exploded side perspective view of an arrow rest providing adjustable lateral plunger depression and return action and adjustable forward plunger rotation and return action;

FIG. 11 is a side sectional assembled view of the arrow rest shown in FIG. 10;

FIG. 12 is a perspective view of a non-folding arrow support wire; and

Figure 13:
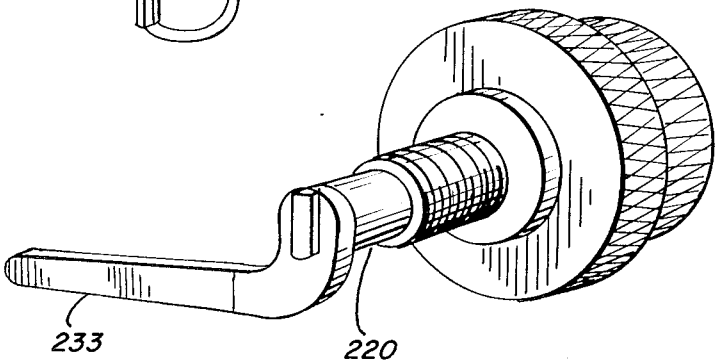

FIG. 13 is a perspective view of another embodiment of a non-folding arrow support.

DESCRIPTION OF PREFERRED EMBODIMENTS

FIG. 1 shows a laterally adjustable arrow rest having a movable arrow support which automatically returns to its initial position installed in through opening 11 in the handle-riser portion 10 of an archery bow as fully described in U.S. Pat. No. 4,548,188. Receiving sleeve 15 is secured and maintained in fixed relation to the bow by sleeve external threads 17 engaging internal threads of through opening 11. Receiving sleeve 15 may be firmly held in position by receiving sleeve holding nut 40 having internal threads 41 engaging receiving sleeve external threads 17 and screwed tightly against the side of the bow handle. The exterior of receiving sleeve holding nut 40 may have flats for engagement of a wrench for tightening. When receiving sleeve holding nut is screwed tightly against the bow handle-riser portion, both receiving sleeve 15 and receiving sleeve holding nut 40 are firmly attached in fixed relation t the bow. It is preferred that receiving sleeve 15 extend at least halfway through the thickness of the bow handle to provide rigidity to the receiving sleeve and to provide longitudinal bearing surface for mounting means 20.

Mounting means 20 is of an elongated shape adapted to fit non-rotatably but freely longitudinally movable within receiving sleeve 15. Receiving sleeve 15 is provided with longitudinal through opening 16 which may be any suitable shape to provide non-rotatable fit and free longitudinal movement to mating elongated mounting means 20. Mounting means 20 extends beyond receiving sleeve 15 on both ends. Various shaped mounting means 20 and mating receiving sleeve through opening 16 may be used, as shown more clearly in the sectional views of FIGS. 2 and 3. The non-circular cross-sectional shape of mounting means 20 provides it a non-rotatable and freely longitudinally movable fit within receiving sleeve through opening 16. FIG. 2 shows mounting means 20 to have a truncated circular cross section and FIG. 3 shows a splined shape for mounting means 20. It is readily apparent that other non-circular shapes would also be suitable.

In one embodiment of the invention, arrow support wire having an arrow support portion 30 is pivotably mounted in the end of mounting means 20 extending from receiving sleeve 15 toward the desired position of arrow shaft 13. In another embodiment shown in FIGS. 9–13 of U.S. Pat. No. 4,548,188 mating mounting plate 80 is retained on the end of mounting means 20 by tubular fitting means 81 and a retractable arrow rest 90 having a flat plate 91 is firmly and replaceably retained in desired position on mating mounting plate 80. The opposite end of mounting means 20 extends sufficiently far to provide holding means, such as holding sleeve 24 for engagement with adjustment drive retainer ridge 52. Mounting means holding sleeve 24 is retained in fixed relation to mounting means 20 by any suitable locking means, such as locking screw 25.

Adjustment drive 50 has internal threads 51 engaging receiving sleeve external threads 17. Rotation of adjustment drive 50 causes lateral movement of the adjustment drive and due to holding means on the end of mounting means 20 being engaged with adjustment drive retainer ridge 52 causes mounting means 20 to move longitudinally within receiving sleeve 15. One suitable means of retaining adjustment drive 50 in a desired position is by providing locking screw 43 through a side wall of receiving sleeve holding nut 40. Receiving sleeve holding nut 40, as shown in FIG. 1, also provides receiving sleeve chamber 42 for general protection of the threaded portions of the arrow rest from the elements.

To provide easy replacement and assembly and disassembly of the arrow rest, adjustment drive 50 is provided with removable cap 55 which may be removed allowing access to removal of locking screw 25 and mounting means holding sleeve 24. After removal of mounting means holding sleeve 24, mounting means 20 may be readily pulled out of the opposite end of receiving sleeve 15. Adjustment drive removable cap 55 may be locked in position by any suitable means such as locking screw 57.

Cap 70 provides a closure for the end of through opening 11 and by abutting against the end of mounting means 20 serves as a cushion and low friction surface for the arrow shaft. As shown in FIG. 4, cap 70 has longitudinal slot 71 to allow placement over bias portion 33 of arrow support wire and slot 72 allowing the desired movement of the arrow support wire. It is apparent that the shape and size of the slots may be altered to fit the desired arrow support wire motion. Cap 70 fits within the end of through opening 11 by friction and seats firmly against the end of mounting means 20 and may be maintained in position by a screw into the end of mounting means 20. Cap 70 may be made of plastic and end surface 73 coated with any suitable material to reduce the frictional drag of the arrow shaft.

In the embodiment shown in FIG. 1, mounting means holding sleeve 24 allows rotation of adjustment drive 50 about it but substantially fills the length of holding sleeve chamber 53. Thus, longitudinal movement of mounting means 20 is controlled solely by longitudinal movement of adjustment drive 50 by engagement with the external threads of receiving sleeve 15. FIG. 5 shows another embodiment of retaining mounting means holding sleeve 24. As shown in FIG. 5, adjustment drive 50 is provided with removable cap 55 which forms chamber 58. The end of removable cap 55 has a hole with internal threads 59 for engagement with second adjustment means in the form of adjustment screw 60 provided with knurled hand portion 61. Spring 65 engages adjustment screw spring seat 62 at one end and the end of mounting means 20 or mounting means holding sleeve 24 at the other end. In this embodiment, in addition to mounting means 20 being adjustable longitudinally with respect to receiving sleeve 15, pressure on the opposite end of mounting means 20 may urge mounting means 20 longitudinally compressing spring 65 which returns mounting means 20 to its original position when the force on the other end is removed. The force necessary to urge mounting means against spring 65 is adjustable by rotation of adjustment screw 60.

The embodiment of the arrow rest shown in FIGS. 6 and 7 achieves generally the same function as the arrow rest shown in FIG. 5. FIG. 6 shows receiving sleeve 15 secured and maintained in fixed relation to the bow by sleeve external threads 17 engaging internal threads of through opening 11. Receiving sleeve 15 may be firmly held in position by receiving sleeve holding nut 40 having internal threads 41 engaging receiving sleeve external threads 17 and screwed tightly against the side of the bow handle. The exterior of receiving sleeve holding nut 40 may have flats for engagement of a wrench for tightening. When receiving sleeve holding nut is screwed tightly against the bow handle-riser portion, both receiving sleeve 15 and receiving sleeve holding nut 40 are firmly attached in fixed relation to the bow.

Mounting means 20 is fit non-rotatably but freely longitudinally movable within receiving sleeve 15. Receiving sleeve 15 is provided with longitudinal through opening 16 which may be any suitable shape to provide non-rotatable fit and free longitudinal movement to mating elongated mounting means 20, such as shown in FIGS. *7a* and *7b*.

To provide easy replacement and assembly and disassembly of the arrow rest as well as adjustment of the force required for lateral movement or depression of mounting means 20, removable adjustment cap 160 threadedly engages internal threads 159 of receiving sleeve 15. The exterior of adjustment cap 160 may have knurled surface 161 for easy adjustment. Adjustment cap 160 may be locked in position by any suitable means such as locking screw 157.

As shown in FIGS. 6 and 7, spring 165 engages holding sleeve flange 126 at one end and the end of adjustment cap 160 at the other end. In this embodiment, in addition to mounting means 20 being adjustable longitudinally with respect to receiving sleeve 15, pressure on the opposite end of mounting means 20 may urge mounting means 20 longitudinally compressing spring 165 which returns mounting means 20 to its original position when the force on the other end is removed. The force necessary to compress spring 165 is adjustable by rotation of adjustment cap 160.

FIGS. 10 and 11 show a laterally adjustable arrow rest which provides adjustable spring biased lateral plunger depression and return and adjustable spring biased forward plunger rotation and return action when installed in through opening 11 in the handle-riser portion 10 of an archery bow. This arrow rest provides both horizontal and vertical cushioning action for the arrow upon its release thereby reducing both horizontal and vertical deviation from a desired flight path. Receiving sleeve 215 is secured and maintained in fixed relation to the bow by sleeve external threads 217 engaging internal threads of through opening 11. Receiving sleeve 215 may be firmly held in position by receiving sleeve holding nut 240 having internal threads 241 engaging receiving sleeve external threads 217 and screwed tightly against the side of the bow handle. The exterior of receiving sleeve holding nut 240 may have a knurled surface for tightening. When receiving sleeve holding nut is screwed tightly against the bow handle-riser portion, both receiving sleeve 215 and receiving sleeve holding nut 240 are firmly attached in fixed relation to the bow. It is preferred that receiving sleeve 215 extend at least halfway through the thickness of the bow handle to provide rigidity to the receiving sleeve and to provide longitudinal bearing surface for mounting means 220.

Mounting means 220 is of an elongated shape adapted to fit freely longitudinally movable with respect to receiving sleeve 215. Mounting means 220 fits non-rotatably and longitudinally movable within rotatable sleeve 270. Receiving sleeve 215 is provided with longitudinal round through opening 216 to provide rotatable fit of rotatable sleeve 270 providing both rotation and free longitudinal movement of elongated mounting means 220 with respect to receiving sleeve 215. Mounting means 220 extends beyond receiving sleeve 215 on both ends. Various cross-sectional shaped mounting means 220 and mating rotatable sleeve 270 through openings may be used, such as shown in the sectional view of FIGS. 2, 3, *7a* and *7b*. The non-circular cross-sectional shape of mounting means 220 provides it non-rotatable and freely longitudinally movable fit within rotatable sleeve 270 through opening. It is readily apparent that other non-circular shapes would also be suitable.

In the embodiment shown in FIGS. 10 and 11, an arrow support wire having arrow support portion 230 is pivotably mounted in the end of mounting means 220 extending from receiving sleeve 215 toward the desired position of the arrow shaft. Other embodiments may use other arrow support means as disclosed herein and in my earlier application and patent to which this application is related. The opposite end of mounting means 220 extends sufficiently far to provide holding means, such as screw threads 224 for engagement with lateral adjustment drive 250. Lateral adjustment drive 250 has internal threads 251 engaging mounting means 220 external threads 224. Rotation of lateral adjustment drive 250 causes lateral movement of the adjustment drive and due to its threaded engagement with the end of mounting means 220 causes mounting means 220 to move longitudinally within rotatable sleeve 270. One suitable means of retaining lateral adjustment drive 250 in a desired position is by providing locking screw 243 engaging the opposite end of internal threads 251 and abutting the end of mounting means 220.

To provide easy replacement and assembly and disassembly of the arrow rest as well as adjustment of the force required for lateral movement or depression of mounting means 220, removable adjustment cap 260 threadedly engages internal threads 259 of receiving sleeve 215. The exterior of adjustment cap 260 is provided with a slot 261 for easy adjustment. Adjustment cap 260 may be locked in position by any suitable means such as locking screw 257. Adjustment cap 260 has a through hole for access to locking screw 243.

As shown in FIGS. 10 and 11, spring 265 engages lateral adjustment drive 250 at one end and the inner side of adjustment cap 260 at the other end. In this embodiment, in addition to mounting means 220 being adjustable longitudinally with respect to receiving sleeve 215, pressure on the opposite end of mounting means 220 by an arrow may urge mounting means 220 longitudinally against the bias of spring 265 which returns mounting means 220 to its original position when the force on the other end is removed. The force necessary to compress spring 265 is adjustable by rotation of adjustment cap 260.

In the embodiment shown in FIGS. 10 and 11, adjustable spring biased forward rotation and return of mounting means 220 is provided by rotation of rotatable sleeve 270 about its longitudinal axis. Forward rotation of rotatable sleeve 270 is limited by rotation guide screw 277 fitting within guide screw limiting well 279 in flange 271. Rotation bias spring 273 has a radially extending end **273*a* which extends through slot 274 in receiving sleeve 215 for engagement with hole 280 in rotation bias adjustment collar 275. By rotation of rotation bias adjustment collar 275, the tension on rotation bias spring 273 may be adjusted with rotation bias adjustment collar 275 being maintained in its desired rotary position by lock screw 278 pressing against receiving sleeve 215. The opposite end 273*b* of rotation bias spring 273 projects laterally and engages spring hole 272 in flange 271 of rotatable sleeve 270. In this manner, adjustable rotation bias is provided to rotatable sleeve 270 and thus to elongated mounting means 220 to provide adjustable spring biased forward rotation of mounting means 220 upon an arrow being released with automatic return rotation of mounting means 220 to its preset rotary position. It is readily apparent that non-adjustable rotation bias may be obtained by engaging one end of rotation bias spring 273 with rotatable sleeve 270 and engaging the opposite end of rotation bias spring 273 in fixed relation to receiving sleeve 215. While use of rotatable sleeve 270 is desired to utilize low friction materials, it is clear that sleeve 270 may be eliminated and mounting means 220 be provided having a round cross section to directly rotate within receiving sleeve 215**.

Cap 290, similar to cap 70, may be placed over the end of mounting means 220 to provide a low friction surface for contact with the arrow shaft. Cap 291 may be placed over the outer diameter of receiving sleeve 215 and extend within holding nut 240 outer sleeve to provide protection from dirt and the elements.

Any suitable arrow support may be mounted at one end of the elongated mounting means. One embodiment is shown in a side view in FIG. 8 and a top view in FIG. 9 with the arrow support wire in its initial predetermined position denoted by I and deflected position denoted by the dashed shape of the wire in position II. The arrow support wire has pivot portion 131 extending through angular bore 121 in the end of mounting means 20. Arrow support portion 130 of the support wire extends beyond the end of mounting means 20 and beyond the side of the bow 10 to the receive arrow shaft. The bias spring 122 is seated in spring chamber 136 and urges against bias portion 132 of the arrow support wire. The force of the bias may be controlled by the gauge of spring wire used or the flexibility of a sheet leaf-type spring. Pivoting of the arrow support portion of the arrow support wire from position I to position II increases the bias force in the spring. When the force of the arrow passing over the arrow support wire is terminated, the bias force in the spring applies force to bias portion 132 sufficient to return support wire bias portion 132 from the side of bias portion chamber 124 to its original predetermined position adjacent the side of bias portion chamber return face 123. It is desired that the pivot portion is on an angle of up to about 45° from vertical so that arrow support wire 130 deflects forwardly and downwardly and mounting means 20 moves inwardly upon passage of an arrow shaft and fletching when the arrow is released from the bow.

One feature of this invention is the full lateral adjustment which is provided by the arrow rest. When deflected into position denoted as II in FIG. 9, arrow support arm 130 is against the side of the bow and there is no mechanism of the arrow rest projecting beyond the side surface of the bow.

FIG. 12 shows another embodiment of mounting means 220 with a fixed arrow support wire 231 of generally U shape having a low friction covering 232 on its outward leg and sized in such a manner that an arrow shaft rests between the free forwardly extending end of U-shaped arrow support wire 231 and low friction ca 290 covering the end of mounting means 220. In this embodiment, arrow support wire 231 is non-movable with respect to mounting means 220 and the downwardly protruding fletching from the arrow shaft rides through the open portion of the U-shaped arrow support wire 231 upon release of the arrow from the bow.

Another embodiment of an arrow support suitable for use in this invention is shown in FIG. 13 wherein extending flexible arrow support 233 is mounted in fixed relation to mounting means 220.

It is to be understood that any of the arrow support means described in this application, my copending application, and my issued U.S. patent which are related to this application, are suitable for use with any of the embodiments of the arrow rests described, that is, an arrow rest which is solely laterally adjustable as described in my issued patent, an arrow rest which is laterally movable against an adjustable lateral spring bias and returned to its original position providing horizontal cushion described in my copending application, or forwardly adjustable spring bias rotatable and automatically returned to its original position providing vertical cushion as described in this application. It is readily apparent that in accordance with the present invention an arrow rest may be provided which is forwardly adjustable spring biased rotatable and automatically returned to its original position: which is (1) not laterally adjustable, (2) laterally adjustable, and (3) laterally movable against an adjustable spring bias. The lateral adjustment feature may be entirely eliminated as is readily apparent, or lateral adjustment may be provided without opposition by an adjustable bias spring as shown in the embodiment of FIG. 1 or by replacement of the lateral bias spring shown in FIGS. 10 and 11 by a strong spring or a hollow tube.

The components of the arrow rest of this invention may be constructed of suitable materials providing durability and weather-resistance. Suitable metals and moldable plastics will be readily apparent. The bias spring means and arrow support wire are preferably fabricated from stainless steel or other corrosion resistant material. Low friction surfaces and rotatable sleeves are preferably Teflon or like material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An arrow rest mountable through a bow handle comprising: a receiving sleeve having a first portion fixedly attachable within a transverse through hole in a bow handle and an outer second portion sized to extend outwardly from said bow handle on the side away from said arrow when fixedly attached in said through hole, said sleeve having a through opening, said receiving sleeve first portion having external threads engageable with mating threads in a holding nut which engages said receiving sleeve external threads and is adapted to abut said bow handle to secure said receiving sleeve in position in said through hole; an elongated mounting means adapted to fit within said receiving sleeve through said opening and having a first end extending from said receiving sleeve first portion and adapted to receive an arrow support means and having an opposite second end extending from said receiving sleeve second portion through said opening, said elongated mounting means mounted spring biased longitudinally slidably and mounted forward rotatably with respect to said receiving sleeve, and a rotation bias spring having one end engaged with respect to said mounting means and an opposite end engaged with respect to said receiving sleeve providing spring biased return force of said rotation bias spring for return of said mounting means to its initial rotary position following forward rotation by the downward force of an arrow on said arrow support means; and an arrow support means attached to said mounting means first end.

2. An arrow rest laterally adjustable with respect to a bow upon which it is mounted comprising:

a receiving sleeve having a first portion fixedly attachable within a transverse through hole in a bow handle and an outer second portion sized to extend outwardly from said bow handle on the side away from said arrow when fixedly attached in said through hole, said sleeve having a through opening, said receiving sleeve first portion having external threads engageable with mating threads in a holding nut which engages said receiving sleeve external threads and is adapted to abut said bow handle to secure said receiving sleeve in position in said through hole;

an elongated mounting means adapted to fit longitudinally movable within said receiving sleeve through said opening and having a first end extending from said receiving sleeve first portion and adapted to receive an arrow support means and having an opposite second end extending from said receiving sleeve second portion through said opening;

an arrow support means attached to said mounting means first end;

lateral adjustment means engaging said second end of said mounting means, movement of said lateral adjustment means moving said mounting means longitudinally with respect to said receiving sleeve;

a lateral bias spring acting upon said lateral adjustment means and a lateral bias spring adjustment means movable with respect to and along the axis of said mounting means adjusting the biased return force of said lateral bias spring for return of said mounting means to its initial lateral position following depression by the force of an arrow on its first end;

said elongated mounting means being mounted rotatably with respect to said receiving sleeve; and a rotation bias spring having one end engaged with respect to said mounting means and an opposite end engaged with respect to said receiving sleeve providing spring biased return force of said rotation bias spring for return of said mounting means to its initial rotary position following forward rotation by the downward force of an arrow on said arrow support means.

3. An arrow rest according to claim 2 additionally having a rotatable sleeve in non-rotatable relation around said elongated mounting means and in rotatable relation within said receiving sleeve through opening; and said rotation bias spring one end is engaged with said rotatable sleeve and said rotation bias spring opposite end is engaged with a rotary adjustable rotation bias adjustment collar lockable in different rotary positions with respect to said receiving sleeve adjusting the biased return force of said rotation bias spring for return of said mounting means to its initial rotary position following forward rotation by the downward force of an arrow on said arrow support means.

4. An arrow rest according to claim 3 wherein said rotation bias adjustment collar has a threaded lock screw threadedly engaged in a threaded through hole in said collar lockedly engaging said receiving sleeve, whereby rotation of said adjustment collar adjusts said rotation bias spring.

5. An arrow rest according to claim 3 wherein said rotation bias spring one end passes through a rotary slot in said receiving sleeve to engage said rotatable sleeve.

6. An arrow rest according to claim 3 wherein said collar has a rotary guide screw slot and a guide screw passing therethrough in screw engagement with a threaded through hole in said receiving sleeve, said guide screw extending inwardly into a guide screw limiting well in said rotatable sleeve limiting rotation of said rotatable sleeve.

7. An arrow rest according to claim 3 wherein said rotatable sleeve has an end flange extending into an enlarged chamber formed by said receiving sleeve, said one end of said rotation bias spring engaged in a hole in said flange and a guide screw extending inwardly into a guide screw limiting well in said flange limiting rotation of said rotatable sleeve.

8. An arrow rest according to claim 2 wherein said rotatable sleeve is a low friction material.

9. In an arrow rest for attachment to the handle portion of a bow and support of an arrow shaft having an arrow support arm and a mounting means for retaining said arrow support arm and means for attachment of said mounting means to said bow, the improvement comprising: said arrow support arm comprising a one-piece arrow support wire of generally downwardly extending U shape having an inward leg attached non-movably with respect to said mounting means and an outwardly free forwardly extending leg whereby said arrow shaft rests only between said free forwardly extending leg and the end of said mounting means, said U shape having an open portion sufficiently large to permit passage of a downwardly protruding fletching of said arrow shaft.

10. An arrow rest laterally adjustable with respect to a bow upon which it is mounted comprising:

an elongated generally cylindrical body having a first portion fixedly attachable within a transverse through holes in a bow handle, said first portion adapted to terminate within said transverse through hole, and an outer larger diameter second portion sized to extend outwardly from and abut said bow handle on the side away from an arrow when fixedly attached in said through hole, at least said first portion having a non-circular, axial through opening;

an elongated non-circular mounting means adapted to fit longitudinally slidable within said non-circular axial through opening and having a first end portion adapted to extend through said transverse hole in said bow handle and having an opposite second end adapted to extend from said bow handle and provided with an end flange;

an arrow support means detachably connected to said mounting means first end;

first positional adjustment means engaged in said larger diameter second portion of said cylindrical body and engaging said second end of said mounting means, movement of said first adjustment means moving said mounting means longitudinally with respect to said cylindrical body, said first positional adjustment means comprising a holding sleeve retainable in stationary axial relation with respect to said mounting means; and second adjustment means engaged with said cylindrical body means and movable axially with respect to said mounting means; a spring biased between said mounting means and an end of said second adjustment means for yieldably retaining said mounting means end flange against said first positional adjustment means.

11. In arrow rest mounted through a bow handle by a receiving sleeve having a first portion fixedly attachable within a transverse through hole in a bow handle and an outer second portion sized to extend outwardly from said bow handle on the side away from said arrow when fixedly attached in said through hole, said sleeve having a through opening, said receiving sleeve first portion having external threads engageable with mating threads in a holding nut which engages said receiving sleeve external threads and abuts said bow handle to secure said receiving sleeve in position in said through hole, having an elongated mounting means adapted to fit within said receiving sleeve through said opening and having a first end extending from said receiving sleeve first portion and adapted to receive an arrow support means and having an opposite second end extending from said receiving sleeve second portion through said opening; and an arrow support means attached to said mounting means first end, the improvement comprising:

said elongated mounting means mounted rotatably with respect to said receiving sleeve by having a rotatably sleeve in non-rotatable relation around said elongated mounting means and in rotatable relation within said receiving sleeve through opening; and a rotation bias spring having one end engaged with said rotatable sleeve and an opposite end engaged with a rotary adjustable rotation bias adjustment collar lockable in different rotary positions with respect to said receiving sleeve adjusting the biased return force of said rotation bias spring for return of said mounting means to its initial rotary position following forward rotation by the downward force of an arrow on said arrow support means.

12. In an arrow rest according to claim 11 wherein said rotation bias adjustment collar has a threaded lock screw threadedly engaged in a threaded through hole in said collar lockedly engaging said receiving sleeve, whereby rotation of said adjustment collar adjusts said rotation bias spring.

13. In an arrow rest according to claim 11 wherein said rotation bias spring one end passes through a rotary slot in said receiving sleeve to engage said rotatable sleeve.

14. In an arrow rest according to claim 11 wherein said collar has a rotary guide screw slot and a guide screw passing therethrough in screw engagement with a threaded through hole in said receiving sleeve, said guide screw extending inwardly into a guide screw limiting well in said rotatable sleeve limiting rotation of said rotatable sleeve.

15. In an arrow rest according to claim 11 wherein said rotatable sleeve is a low friction material.

16. In an arrow rest according to claim 11 wherein said rotatable sleeve has an end flange extending into an enlarged chamber formed by said receiving sleeve, said one end of said rotation bias spring engaged in a hole in said flange and a guide screw extending inwardly into a guide screw limiting well in said flange limiting rotation of said rotatable sleeve.

17. In an arrow rest according to claim 11 wherein said mounting means is longitudinally movable within said rotatable sleeve.

* * * * *